United States Patent [19]

Lanzisera

[11] 4,177,534

[45] Dec. 11, 1979

[54] WASHING MACHINE FOR CLEANING COOKING POTS OR SIMILAR ARTICLES

[76] Inventor: Joseph C. Lanzisera, 43 Jackson Ave., Bayville, Long Island, N.Y. 11709

[21] Appl. No.: 855,202

[22] Filed: Nov. 28, 1977

Related U.S. Application Data

[63] Continuation-in-part of Ser. No. 675,923, Apr. 12, 1976, Pat. No. 4,069,533.

[51] Int. Cl.[2] ..... A46B 13/06

[52] U.S. Cl. ..... 15/56; 134/168 R

[58] Field of Search ..... 15/56–58, 15/70–73, 75, 76, 101; 134/167 R, 168 R

[56] References Cited

FOREIGN PATENT DOCUMENTS

| | | | |
|---|---|---|---|
| 1218501 | 12/1959 | France | 15/56 |
| 1439607 | 4/1966 | France | 15/56 |
| 509321 | 1/1955 | Italy | 15/71 |

*Primary Examiner*—Edward L. Roberts

*Attorney, Agent, or Firm*—Irving M. Kriegsman

[57] ABSTRACT

Apparatus is disclosed for cleaning the inside and outside surfaces of a cooking pot. The apparatus includes an upwardly extending washer-scrubber unit for washing and scrubbing the inside surfaces of the cooking pot and a downwardly extending washer-scrubber unit for washing and scrubbing the outside surfaces of the cooking pot. The upwardly extending washer-scrubber unit includes a scrubbing element mounted on a rotating sprinkler having two sets of nozzles, one set of nozzles for producing rotational movement of the sprinkler and the other set of nozzles for spray washing the inside surfaces of the cooking pot. The downwardly extending washer scrubber unit includes a scrubbing element mounted on a rotating sprinkler having spray type end nozzles. A washing machine having a plurality of the upwardly extending washer-scrubber units and a plurality of the downwardly extending washer scrubber units for cleaning a plurality of cooking pots either simultaneously or in sequence is also disclosed.

6 Claims, 13 Drawing Figures

WASHING MACHINE FOR CLEANING COOKING POTS OR SIMILAR ARTICLES

CROSS-REFERENCE TO RELATED APPLICATIONS

This application is a continuation-in-part of my copending patent application Ser. No. 675,923 filed Apr. 12, 1976 now U.S. Pat. No. 4,069,533.

BACKGROUND OF THE INVENTION

This invention related to washing machines. More particularly, this invention relates to washing machines for cleaning cooking pots or similar articles.

In order to effectively and efficiently clean a cooking pot it is usually necessary that its inner and outer surfaces be scrubbed with a brush or scouring pad. Simply immersing the pot in a cleaning solution and then agitating the cleaning solution or spray washing the surfaces of the pot with a cleaning fluid will not generally remove all of the food particles, grease or other foreign matter that might adhere to it during normal usage. Domestic and commercial washing machines for dishes, glasses and eating utensils are normally provided with some type of means for washing and rinsing the articles being cleaned but are not provided with any means for actually scrubbing the surfaces of the articles that are being cleaned. Consequently, cooking pots and other similar articles are normally cleaned by hand which can be very hard work, very time consuming and can have adverse effects on the natural skin beauty of the hands.

In U.S. Pat. Nos. 843,555, 1,018,046, 1,492,925, 1,602,667, 2,062,664, and 2,475,407 are disclosed different types of washing machines for cleaning various types of articles. In each one of these patents the articles being cleaned are first placed in the machine in an inverted position and are then spray washed with a liquid supplied through suitably positioned nozzles or jets. None of the machines described in these patents are provided with any means for scrubbing the articles while they are being washed and none of the machines described in these patents are designed or suited specifically for cleaning cooking pots.

In U.S. Pat. No. 2,908,598 is disclosed a machine for cleaning glass articles, such as tumblers, one at a time. The machine includes a plurality of rotating, mechanically driven, brushes which scrub the interior and exterior surfaces of the article being cleaned.

In U.S. Pat. No. 2,558,628 is disclosed a machine for washing milking machines in which the action of a fluid ejected through nozzles at the ends of a blade is used to produce rotational movement of a frame having a plurality of upstanding spray tubes. The machine does not include any brushes or other means for scrubbing the surfaces of the milking machines.

Other patents considered pertinent in one way or another to this invention include U.S. Pat. No. 1,622,130; British Patent No. 306,694; and French Patents Nos. 1,218,501; 1,260,935; and 1,439,607.

SUMMARY OF THE INVENTION

It is an object of this invention to provide a new and improved washing machine.

It is another object of this invention to provide a washing machine for cleaning cooking pots and similar articles.

It is still another object of this invention to provide a new and novel technique for producing rotational movement of a scrubbing brush for use in cleaning a cooking pot.

It is yet still another object of this invention to provide a new and novel device for washing the inside surfaces of a cooking pot or similar article.

It is another object of this invention to provide a new and novel device for washing the outside surfaces of a cooking pot or similar article.

It is still another object of this invention to provide a washing machine capable of cleaning a plurality of cooking pots at the same time and wherein the cleaning cycle for each pot may be independently controlled.

It is yet still another object of the invention to provide a washing machine for washing and scrubbing cooking pots and similar articles.

It is another object of this invention to provide a washing machine for cleaning pots that includes means for scrubbing the interiors and exteriors of each pot being cleaned at the same time as it is being washed.

It is still another object of this invention to provide a new and novel method for simultaneously washing and scrubbing a surface which is to be cleaned.

It is yet still another object of this invention to provide a new and novel apparatus for washing and scrubbing the inside surface of a cylindrically-shaped container.

Finally, it is an object of the invention to provide an apparatus for washing and scrubbing cooking pots which is relatively simple in construction and which can be easily incorporated into most commercial and domestic dishwashers.

The above and other objects are achieved by constructing a washing machine according to this invention.

One of the principal features of this invention involves the concept of mounting a scrubbing element on a rotating sprinkler to provide a means for scrubbing a surface of a cylindrical container at the same time as it is being spray washed.

A washing machine constructed according to this invention includes a plurality of upwardly extending washer-scrubber units. Each unit is used to clean the inside surfaces of a single article. Each unit includes a scrubbing device fastened to a rotating sprinkler assembly. The rotating sprinkler assembly is equipped with two sets of nozzles. One set of nozzles is arranged to spray wash the insides of the article being cleaned, while the other set of nozzles is arranged to produce rotational movement of the sprinkler. The washing machine further includes a plurality of downwardly extending washer-scrubber units, each of which is made up of a scrubbing device mounted on a rotating sprinkler for washing the outside surfaces of a single one of the articles.

BRIEF DESCRIPTION OF THE DRAWINGS

In the drawings wherein like reference numerals represent like parts.

DETAILED DESCRIPTION

Figure 6:
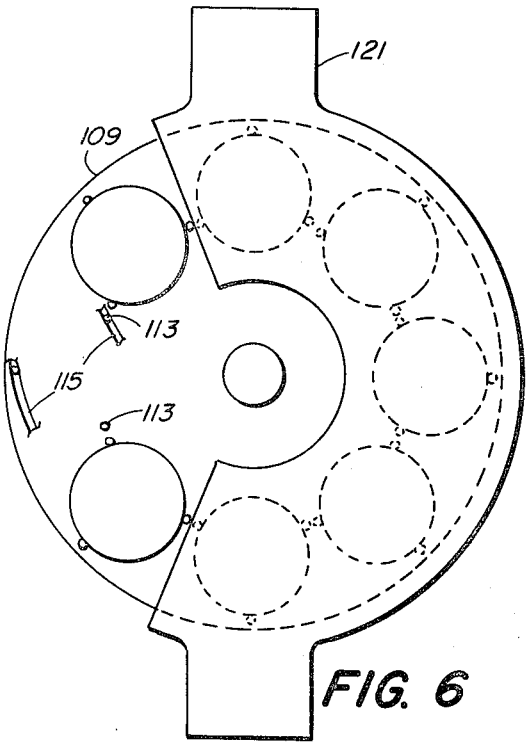
FIG. 6 is an end view of the washing machine shown in FIG. 5.

Referring to the drawings, there is shown in FIGS. 1–4 a washing machine 11 constructed according to this invention. The washing machine 11 includes a casing 13 which forms a closed chamber where the pots P (or similar articles) are cleaned. The casing 13 includes a door 15 through which the pots P may be inserted into the chamber and a removable panel 17 behind which are located the various pumps, cams, timers, solenoids, motor and switches, etc. for operating the machine. The door 15 is mounted on the casing 13 by hinges 19 and includes a glass window 21 for viewing the chamber.

Figure 3:
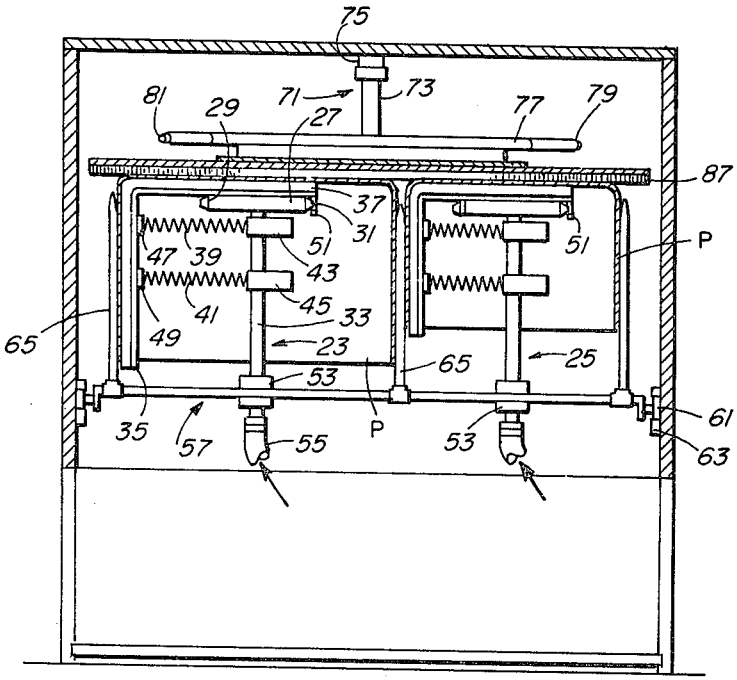
FIG. 3 is a sectional elevation view taken along lines 3—3 in FIG. 2.
Figure 9:
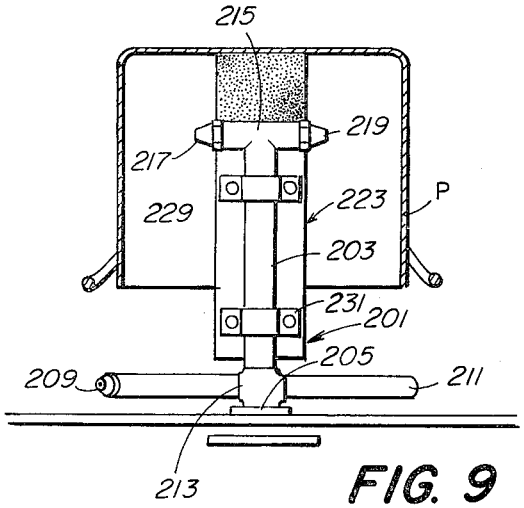
FIG. 9 is a front elevation view of another embodiment of one of the upwardly-extending washer-scrubber units.

Inside the chamber are a plurality of upwardly extending washer-scrubber units. In order not to render the drawings entangled, the section view in FIG. 3 is taken in such a way that only two upwardly extending washer-scrubber units 23 and 25 are shown. The pots P to be cleaned are placed on top of the upwardly extending washer-scrubber units in an inverted position. Except for size, the upwardly extending washer-scrubber units are all identical. Consequently, only washer-scrubber unit 23 will be described in detail.

Unit 23 is made up basically of a brush assembly mounted on a rotating sprinkler.

The rotating sprinkler includes a horizontal pipe 27 having spray type end nozzles 29 and 31. Horizontal pipe 27 is rigidly mounted on the top of a vertical pipe 33 so as to form a "T", with the interiors of the two pipes 27 and 33 being in communication with each other.

The brush assembly includes an "L" shaped brush 35 which is removably mounted by suitable means (not shown) on an "L" shaped brush holder 37. The "L" shaped brush holder 37 is mounted for slidable movement along the top of the horizontal pipe 27. A pair of springs 39 and 41 are connected to the vertical pipe 33 by brackets 43 and 45 and to the brush holder 37 by lugs 47 and 49 so as to push brush holder 37 away from pipe 33 and cause the vertical arm of brush 35 to come into contact with the inner side wall of the pot P. A stop 51 on the end of brush holder 37 limits the slidable movement of brush holder 37 along the horizontal pipe 27. Vertical pipe 33 is rotatably mounted on a joint or coupling 53. A rubber hose 55 is attached to the coupling 53 and is connected to a source of water or cleaning solution under pressure (not shown). Except for the size of the brush, the brush holder and the horizontal pipe, washer-scrubber unit 25 is identical to washer-scrubber unit 23.

Couplings 53 are fixedly mounted on a pull-out tray 57 made up essentially of a plurality of longitudinal and lateral ribs 59. Tray 57 is slidably mounted by wheels 61 on tracks 63 fixed to the sidewalls of the chamber. A plurality of upwardly extending rubber pipes or fingers 65 are mounted for slidable movement on the ribs 59. The fingers 65 are provided with spring biased lock means (not shown) so that they can be held at desired locations. In use, the fingers 65 are nested up against the outer walls of the pots P in order to prevent tilting or rotational or sidewise movement of the pots P during the cleaning operation.

Machine 11 further includes a downwardly extending washer-scrubber unit 71 for washing and scrubbing the bottom outer surfaces of the pots P. Unit 71 also serves to hold down the pots P while their inner surfaces are being cleaned. Unit 71 is also made up basically of a brush assembly mounted on a rotating "T" shaped sprinkler. Specifically, unit 71 includes a vertical pipe 73 rotatably mounted on its upper end to a coupling 75 secured to the top wall of the chamber at the center. The coupling 75 is connected by a pipe or hose (not shown) to a source of fluid under pressure (not shown). A horizontal pipe 77 having spray-type end nozzles 79 and 81 is rigidly fixed to the bottom end of pipe 73 so as to form an inverted "T", with the interiors of the two pipes being in communication with each other. Rigidly secured to the horizontal pipe 77 and positioned directly underneath the horizontal pipe 77 is a spider assembly 81 made up of a circular plate 83 having a plurality of radially extending removable arms 85. A removable brush 87 is mounted on the underside of each arm 85.

In operation, the tray 57 is pulled out and the pots P which are to be cleaned are placed on top of the upwardly extending washer-scrubber units in an inverted position. The center of each pot P is lined up with the axis of rotation of its respective washer-scrubber unit. Once the pots are properly positioned, fingers 65 are nested up against the sides of the pots P and locked in place to prevent the pots P or the handles on the pots P from moving or tilting during the washing and scrubbing cycle. The tray 57 is then pushed back into the chamber. The spacing between the upwardly extending washer-scrubber units and the downwardly extending washer scrubber unit is such that the brushes 87 contact the outer bottom surfaces of the pots P. The sprinklers are activated by directing water or other cleaning solution under pressure through vertical pipes and out through the end nozzles in the horizontal pipes. Fluid emerging through the end nozzles produce a rotational movement of the sprinklers. As the sprinklers turn, the brushes also move since they are mounted on the sprinklers and as a result scrub the surfaces that are being spray washed.

The machine 11 is preferably cycled so that the washer-scrubber unit for the outside bottom surface of the pots P is not activated at the same time as the washer-scrubber units for the inside surfaces of the pots P. In this way the washer-scrubber unit for the outside bottom surfaces of the pots P also serves to hold the pots P down in place while the inside surfaces are being cleaned. The cycling may also be arranged so that the inside surfaces of each pot P are cleaned in sequence rather than simultaneously. The desired cycling of the machine 11 may be obtained by using any conventional arrangement of cams, limit switches and solenoid valves (not shown). Used cleaning solution drains out of the chamber of the machine through a filter 91 at the bottom of the chamber.

The brush holders for the inside surfaces are self-adjusting due to the action of the springs connected between the vertical pipes and the brush holders and can thus accomodate different sized pots. The only limitation with regard to the size of the inside washer-scrubber units is that the length of the horizontal arms of the brushes as well as the length of the horizontal pipes be less than the diameter of the pot P it is intended to support. Therefore, to accommodate very small as well as very large pots, it may be desirable to have different sized washer-scrubber units, as is shown in the drawings.

Figure 5:
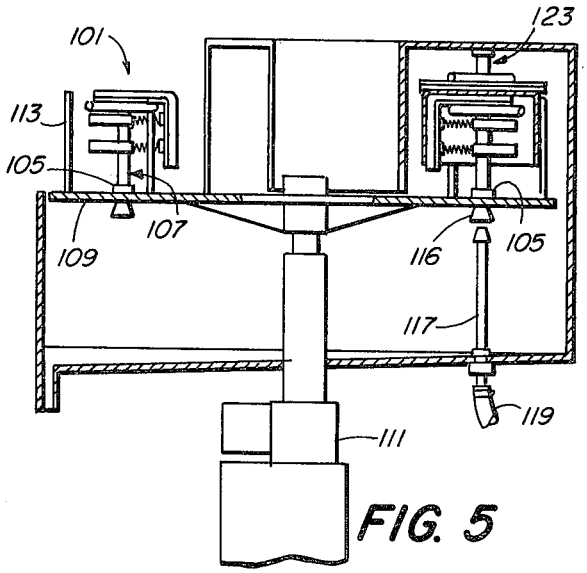
FIG. 5 is a section view of another embodiment of a washing machine constructed according to this invention.
Figure 4:
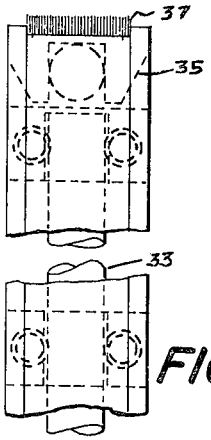
FIG. 4 is a sectional end view of one of the upwardly extending washer-scrubber units shown in the washing machine in FIG. 2.
Figure 1:
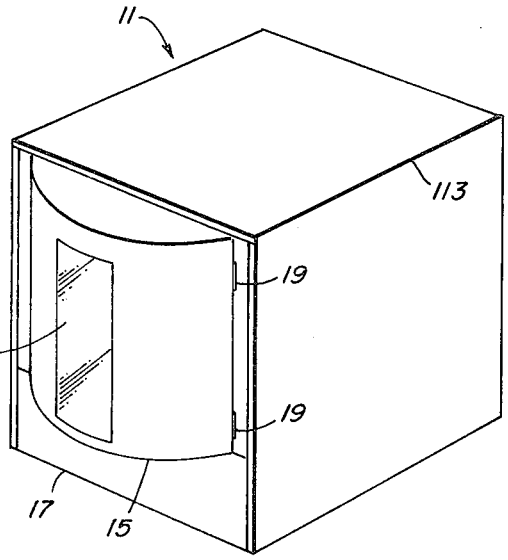
FIG. 1 is a perspective view of a washing machine constructed according to this invention.

In FIGS. 5 and 6 is a second embodiment of the invention. In this embodiment of the washing machine designated by reference numberalreference numeral 101, the couplings 105 for the upwardly extending washer-scrubber units 107 are mounted on a turntable 109 which is driven by an indexing motor 111. Movable fingers 113 for holding the pots P in position are mounted in circular grooves 115 on the turntable 87. As the turntable 109 is moved each coupling 105 is successively brought into registration with a jetstream of water from a nozzle 116 which is connected by a pipe 117 to a hose 119 connected to a source of water or other cleaning solution (not shown). Extending downward from the top wall 121 of the cover of the machine 101 and in alignment with the nozzle 115 is a downwardly extending washer- scrubber unit 123 (similar to the downwardly extending washer-scrubber unit in the FIG. 1 embodiment) for washing the outer bottom surface of the pots.

Figure 8:
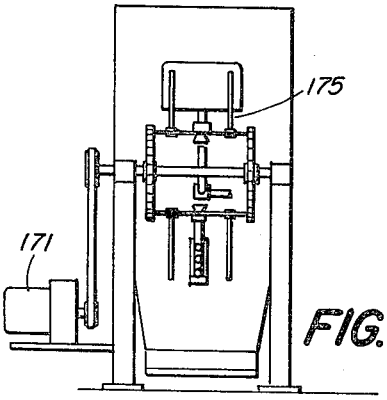
FIG. 8 is an end view of the washing machine shown in FIG. 7.
Figure 7:
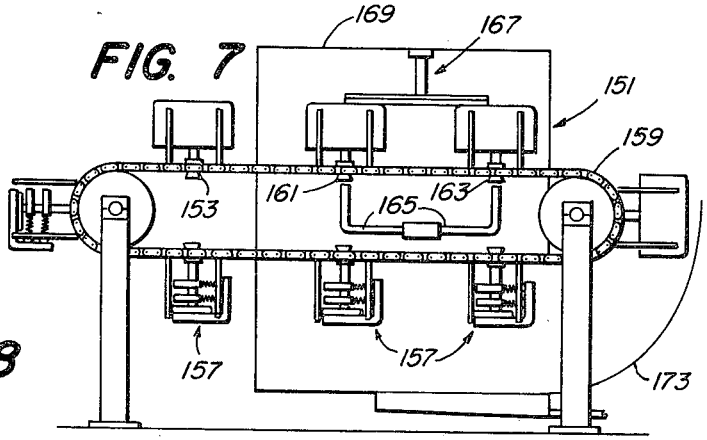
FIG. 7 is a section view of another embodiment of a washing machine constructed according to this invention.
Figure 2:
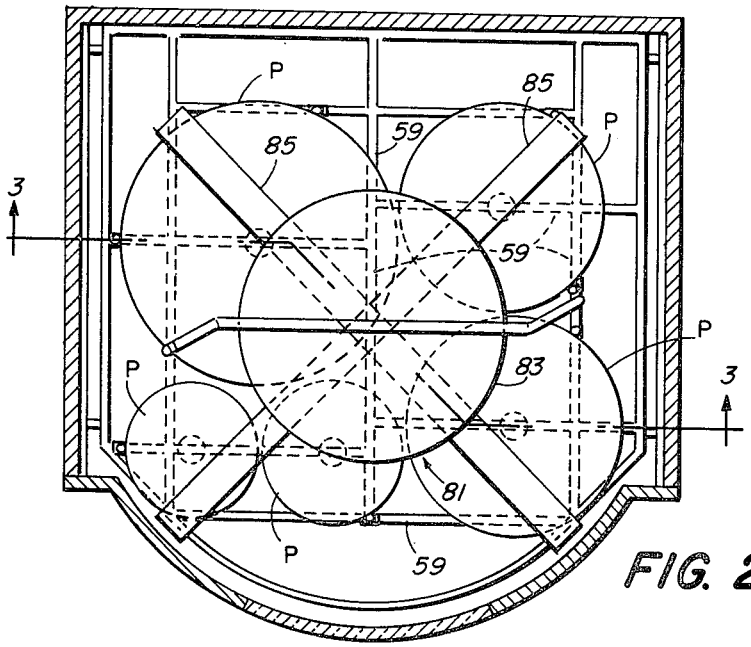
FIG. 2 is a sectional plan view of the washing machine shown in FIG. 1.

In FIGS. 7 and 8 is a third embodiment of the invention. In this embodiment of the washing machine designated by the reference numeral 151, the couplings 153 of the washer-scrubber units 157 are mounted on a pair of straight line index type conveyor chains 159 and are unconnected at their bottom ends (similar to the couplings 105 in the FIG. 5 embodiment). Machine 151 includes a pair of jet nozzles 161 and 163 connected by a pipe 165 to a source of water or other cleaning solution under pressure (not shown). Machine 151 also includes a downwardly extending washer-scrubber unit 167 fixed to a hood 169 (and similar to the washer-scrubber unit 123 in the FIG. 5 embodiment). Chains 159 are driven by an indexing motor 171. After the pots P are cleaned they drop off into a chute 173. Adjustable fingers 175 for holding the pots P in position are mounted on carrier rods 177 connected to the chains 159.

Figure 12:
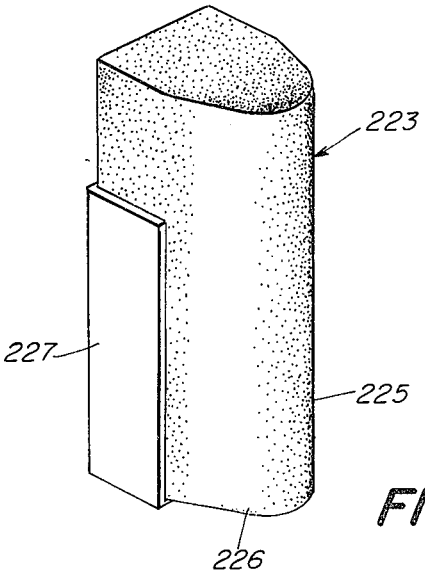
FIG. 12 is an exploded perspective view of the scouring pad assembly shown in FIG. 9.

In FIGS. 9 through 12 there is shown another embodiment of one of the upwardly extending washer-scrubber units. In this embodiment, the upwardly extending washer-scrubber unit, which is identified by reference numeral 201, includes a vertical pipe 203 which is rotably mounted on a coupling 20. Coupling 205 is adapted to be connected to a source of cleaning fluid under pressure (not shown). A first horizontal pipe 207 having end nozzles 209 and 211 angled so as to produce sprinkler type rotation of pipe 203 when fluid is ejected therefrom is fixedly connected to pipe 203 via a coupling 213, the interiors of pipes 203 and 207 being in communication with each other. A second horizontal pipe 215 having a pair of spray type end nozzles 217 and 219 is fixedly connected to pipe 203 at the top, the interiors of pipes 203 and 215 also being in communication. Finally, upwardly extending washer-scrubber unit 201 includes a flexible scouring pad assembly 223. As can be seen in FIG. 12, scouring pad assembly 223 includes scouring pad 225, which is glued to a body 226 of foam rubber. Body 226 is, in turn, glued to a holder 227 made of metal or plastic. Scouring pad assembly 223 is eccentrically mounted on vertical pipe 203 by means of clamps 229 and 231. The length of vertical pipe 203 is greater than the height of pot P. Consequently, when pot P is seated on scouring pad 223, it will not extend over vertical pipe 203.

Rotational movement of upwardly extending washer-scrubber unit 201 is produced through the action of fluid under pressure traveling up pipe 203, through pipe 207 and out through end nozzles 209 and 211. The inside surface of pot P is spray washed through the action of fluid traveling up pipe 203, through pipe 215 and out through spray nozzles 217 and 219.

The principal advantage of washer-scrubber unit 201 is that since pot P does not extend over pipe 207, the length of pipe 207 and hence the amount of torque that can be developed to produce the rotational movement is not limited to the inside diameter of pot P. If desired, additional torque can be realized by angling nozzles 217 and 219 and lengthening pipe 215 such that it also produces rotation when the fluid is ejected therefrom.

The width W of pad assembly 223 is slightly greater than the inside radius of pot P. Consequently pad assembly 223 is compressed inwardly when the pot P is placed over it and pushed down into position.

Figure 13:
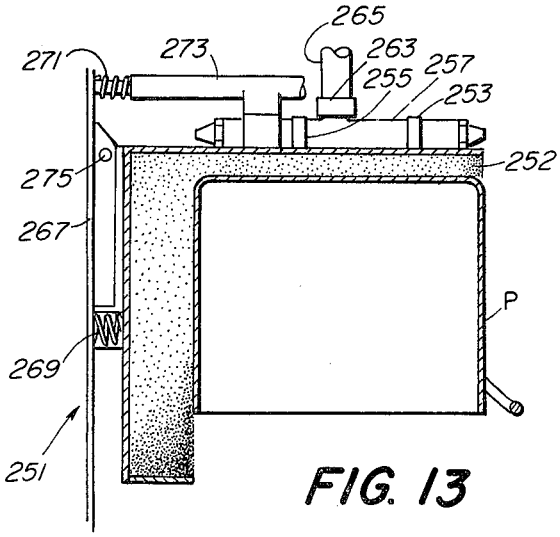
FIG. 13 is a front elevation view another embodiment of one of the downwardly extending washer-scrubber units.
Figure 10:
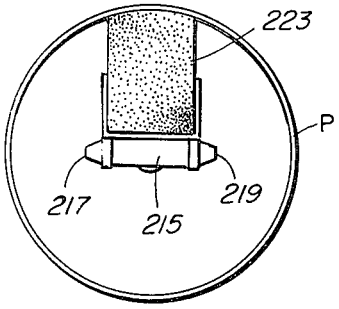
FIG. 10 is a plan view of the upper horizontal pipe, spray producing nozzles and scouring pad portion of the unit shown in FIG. 9.
Figure 11:
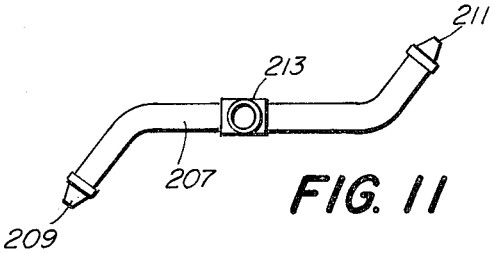
FIG. 11 is a plan view of the lower horizontal pipe and rotation producing end nozzles of the unit shown in FIG. 9.

In FIG. 13 there is shown another embodiment of the downwardly extending washer-scrubber unit for cleaning the outer surfaces of pot P. In this embodiment, the washer-scrubber unit, which is identified generally by reference numeral 251, includes an inverted flexible scouring pad 252 mounted by clamps 253 and 255 on a horizontal pipe 257. The ends of pipe 257 are equipped with spray type nozzles 259 and 261 which are angled to produce rotational movement of the unit. Pipe 257 is connected via a joint 263 to a vertical pipe 265, the interiors of the pipes 257 and 265 being in communication. Pipe 265 is rotably mounted to a coupling (not shown) which is connected to a source of fluid under pressure (not shown). A pressure arm 267 connected to the vertical leg of scouring pad 252 by a tension spring 269 and to horizontal pipe 257 via a spring 271 and bracket 273 and arranged to pivot about a pin assembly 275 keeps the vertical leg of pad 252 against the outer side of pot P but allows outward movement of pad 252 as it scours against the handles of pot P.

Fluid under pressure travelling down through pipe 265, through pipe 257 and out through spray nozzles 259 and 261 produces rotational movement of washer-scrubber unit 251.

It is to be understood that one or more upwardly extention washer-scrubber units and one or more downwardly extending washer-scrubber units constructed according to this invention for cleaning the inner surfaces of a pot could easily be incorporated into a commercial or domestic dishwashing machine so that the machine could be used to clean pots at the same time as it cleans dishes. For example, one or more upwardly extending washer-scrubber units could probably be mounted on the bottom pull-out tray and one or more downwardly extending washer-scrubber units could be mounted on to the top of the chamber in a conventional household dishwasher with a minimum amount of design changes.

The embodiments of the present invention are intended to be merely exemplary and those skilled in the art shall be able to make numerous variations and modifications without departing from the spirit and scope of the present invention. For example, instead of a rotating sprinkler assembly wherein the horizontal pipe is fixed to a vertical pipe that is rotatably mounted on a coupling, a sprinkler could be provided where the horizontal pipe is rotatably mounted on a vertical pipe that is fixedly mounted on a coupling. These and all other such variations and modifications are intended to be within the scope of the present invention as defined in the appended claims.

What is claimed is:

1. Apparatus for cleaning a cooking pot comprising an upwardly extending washer-scrubber unit for washing and scrubbing the inside surface of said cooking pot, said upwardly extending washer-scrubber unit comprising:

(a) a rotably mounted vertical pipe, (b) scrubbing means fixedly mounted on said vertical pipe and adapted to support said cooking pot when said cooking pot is placed thereon in an inverted position and contact the inside of said cooking pot, (c) a first horizontal pipe, having angled end nozzles, fixedly attached to said vertical pipe, the interiors of the two pipes being in communication, said first horizontal pipe being positioned on said vertical pipe so as to be below the cooking pot when the cooking pot is mounted on the scrubbing means, (d) a second horizontal pipe having spray end nozzles, fixedly attached to said vertical pipe, the interiors of the two pipes being in communication, said second horizontal pipe being positioned on said vertical pipe so as to be inside said cooking pot when said cooking pot is mounted on said scrubbing means, and (e) means for supplying fluid under pressure to said interior of the vertical pipe, (f) whereby said fluid emerging from the nozzles of the first pipe will produce rotational movement of the vertical pipe and the fluid emerging from the nozzles of the second pipe will spray wash the inside of the cooking pot.

2. The apparatus of claim 1 and wherein the scrubbing means is a flexible scouring pad.

3. The apparatus of claim 2 and wherein the length of the first horizontal pipe is greater than the diameter of the cooking pot.

4. The apparatus of claim 3 and wherein the scrubbing means is mounted on the vertical pipe by clamps.

5. The apparatus of claim 4 and further including a downwardly extending washer-scrubber unit for spray washing and scrubbing the outside surfaces of the container cooking pot, said downwardly extending washer-scrubber unit including a rotably mounted sprinkler having spray type end nozzles and, a scrubbing element mounted on said sprinkler and means including a pivotally mounted pressure arm for pushing said scrubbing element up against the outside surfaces of the cooking pot.

6. The apparatus of claim 1 and wherein the end nozzles on the first horizontal pipe are spray type end nozzles.

* * * * *